US006374063B1

(12) United States Patent
Todome

(10) Patent No.: US 6,374,063 B1
(45) Date of Patent: Apr. 16, 2002

(54) FIXING DEVICE USED FOR IMAGE FORMING APPARATUS

(75) Inventor: Tsuyoshi Todome, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/671,154

(22) Filed: Sep. 28, 2000

(51) Int. Cl.[7] ..... G03G 15/00; G03G 15/20

(52) U.S. Cl. ..... 399/18; 399/22; 399/92

(58) Field of Search ..... 399/18, 21, 22, 399/33, 92, 124, 81; 271/273, 272

(56) References Cited

U.S. PATENT DOCUMENTS 4,025,180 A * 5/1977 Kurita et al. ..... 399/92
4,391,509 A * 7/1983 Cavagnaro ..... 399/18

FOREIGN PATENT DOCUMENTS

JP 4-96077 3/1992

* cited by examiner

*Primary Examiner*—Sophia S. Chen
(74) *Attorney, Agent, or Firm*—Foley & Lardner

(57) ABSTRACT

An image forming apparatus is provided with an electrostatic charging unit, an exposure unit, a developing unit, a feeding unit, a transfer unit, a peeling-off unit, a fixing device and also a cooling mechanism used when taking out a jamming sheet in the fixing device. The fixing device consists of a fixing unit having fixing rollers and discharge guide unit for discharging a sheet after fixed by the fixing unit. The cooling mechanism, such as, a cooling fan or a refrigerant cooling unit, is provided at the discharge guide, to cool the jamming sheet that has caused jamming only in the fixing unit and discharged therefrom. Time for cooling the jamming sheet may be controlled by a user manual operation or for a predetermined period within a recovery allowable time, so as not to cool the fixing rollers, which would otherwise cause a long recovery time. Or, the cooling mechanism may start a cooling operation after detecting that a door provided at the front of the image forming apparatus has been opened for taking out the jamming sheet.

16 Claims, 8 Drawing Sheets

FIXING DEVICE USED FOR IMAGE FORMING APPARATUS

BACKGROUND OF THE INVENTION

The present invention relates to an image forming apparatus such as a plane paper color copy machine and a printer, for printing data transferred from an image data supplying apparatus such as a personal computer and a digital camera, on plane papers or OHP sheets. Particularly, this invention relates to a fixing device having a cooling mechanism for cooling a medium to be taken out when a paper jam occurs while fixing a color material deposited on the medium.

An image forming apparatus is generally equipped with an optical unit, an exposure unit, a developing unit, a paper-feeding unit, a transfer unit, a fixing unit, and so on.

The paper-feeding, transfer and fixing units would suffer a paper jam in which any of the units is jammed by sheets of paper as an image forming medium on which an image is formed.

A paper jam could occur anywhere in the units to which sheets are transferred. When a paper jam occurs in the fixing unit that has been generating a high heat, a user has to open a hinged door of an image forming apparatus to find a unit that has been suffering a paper jam for taking out the jamming sheets (a jam process).

Such a jam process annoys a user, particularly when it occurs to the fixing unit because jamming papers are often heated when a hinged door of an image forming apparatus is opened due to the facts that a paper jam occurs right after a fixing process or a heat-generating fixing unit is very close to the papers.

Rapid cooling to the fixing unit for taking out the jamming papers when a paper jam occurs around the fixing unit could cause temperature decrease to the fixing unit while toner has been attached to the unit, the cooled toner being hardly peeled off.

SUMMARY OF THE INVENTION

A purpose of the present invention is to provide an image forming apparatus having a cooling mechanism that offers a jam process without annoying a user when performed to a fixing unit, and without getting a fixing roller dirty by cooling only the outlet of the fixing unit and its peripheral.

In order to meet the purpose, a fixing device of an image forming apparatus according to the first basic configuration of the present invention is an fixing device of an image forming apparatus, heated and fixed by which is an image forming medium transferred on which is a toner image formed on an image fixing body by an electrophotography process, the fixing device including: a fixing unit that presses and heats the image forming medium to be fixed by a pair of fixing rollers; medium holding means provided at an outlet side of the fixing unit for holding the image forming medium, on which an image has been fixed, transferred and discharged from the fixing unit; jam detecting means for detecting a jam in which the image forming medium has been caught between the fixing rollers and not moving; cooling means including a cooling mechanism for cooling the medium holding means and jamming image forming medium and a drive mechanism for driving the cooling mechanism; and drive admitting means for admitting the drive mechanism to drive the cooling mechanism to cool the medium holding means and the jamming image forming medium located in the vicinity of the medium holding means when the jamming image forming medium is detected by the jam detecting means.

The drive admitting means may include a manual switch that is provided inside a door provided at a front body of the image forming apparatus, for the cooling means to start by a user manual operation. Or, it may be an automatic drive admitting means by which a switch is turned on when the door provided at the front body is opened. Moreover, it is preferable that, under combination of the manual switch and automatic control, for example, the cooling means is automatically driven when the door is opened to cool at once the medium holding means and a jamming image forming medium that is located in the vicinity of the medium holding means, and the cooling means is stopped by means of the manual switch when the medium holding means and the jamming image forming medium have been cooled enough.

For drive admission by a manual operation, it is preferable that the drive mechanism of the cooling means is stopped when a user has not depressed the manual button anymore.

For automatic control, it is preferable that, after the driving mechanism of the cooling means has started to drive, cooling is performed for a fixed period in which the drive mechanism has continued driving until a predetermined period passes, and the drive mechanism automatically stops when the predetermined period has passed.

The cooling means may, in general, be constituted by a cooling fan as a cooling mechanism and a motor as a drive mechanism for rotating the cooling fan. The drive admitting means as a manual operating means thus can be an on-off switch for a cooling fan-driving motor. The cooling means may be constituted, as a unique configuration, by a cooling mechanism in which a refrigerant pipe is provided along the bottom of a receiving plate of the medium holding means, such as, a discharge transfer guide and a drive mechanism for cooling by circulating a refrigerant through the refrigerant pipe of the cooling mechanism.

Configured as above, when a paper jam occurs in the fixing unit, a discharge transfer guide at the discharge side and an image forming medium, such as, a jamming sheet that has been discharged to the discharge side only are cooled without cooling the fixing unit itself. Therefore, a user can take out an image forming medium caught in the fixing unit with no uncomfortable feeling when performing a jam process.

Moreover, the medium holding means, such as, a guide at the discharge side and an image forming medium, such as, a jamming sheet located in the vicinity of the medium holding means only are cooled without sending a cool wind or cool air to the fixing unit itself, thus no occurrence of attachment of toner, for example, to the fixing rollers due to cooling. The present invention thus achieves a cooling mechanism of a fixing device easy for post-processing.

A method of controlling a cooling mechanism of a fixing device according to the second basic configuration of the present invention is a method of controlling a cooling mechanism of a fixing device of an image forming apparatus, heated and fixed by which is an image forming medium transferred on which is a toner image formed on an image fixing body by an electrophotography process, the fixing device including a fixing unit that presses and heats the image forming medium to be fixed by a pair of fixing rollers, medium holding means provided at an outlet side of the fixing unit for holding the image forming medium, on which an image has been fixed, transferred and discharged by the fixing unit, jam detecting means for detecting a jam in which the image forming medium has been caught between the fixing rollers and not moving, and cooling means including a cooling mechanism for cooling the medium holding means and jamming image forming medium and a drive mechanism for driving the cooling mechanism, the method including the steps of: detecting a jam in which the image forming medium has been caught between the fixing rollers and not moving by the jam detecting means; and admitting the drive mechanism to drive the cooling mechanism to cool the medium holding means and the jamming image forming medium located in the vicinity of the medium holding means.

In the method of controlling a cooling mechanism of a fixing device according to the second basic configuration, the step of admitting the drive mechanism to drive may include the step of driving the drive mechanism of the cooling means by a user manual operation.

In this method, the step of driving by the user manual operation may be performed by depressing a drive switch for starting the drive mechanism to drive the cooling mechanism.

In this case, it is preferable that the cooling means includes a cooling fan as the cooling mechanism for sending a specific airflow in a direction of the medium holding means and a drive motor as the drive mechanism for rotating the cooling fan, the step of driving by the user manual operation being performed by depressing a drive switch for starting the drive mechanism to drive the cooling fan provided in the vicinity of the fixing rollers.

Moreover, in this case, it is preferable that the cooling means includes a refrigerant cooling unit as the cooling mechanism that is provided at a transfer plate that is included in the medium holding means, for cooling the transfer plate by using a refrigerant and a refrigerant circulating unit for circulating the refrigerant of the refrigerant cooling unit, the step of driving by the user manual operation being performed by depressing a drive switch for driving circulation of the refrigerant of the refrigerant cooling unit provided at an outlet side of the fixing rollers.

In the method of controlling a cooling mechanism of a fixing device according to the second basic configuration, the step of admitting the drive mechanism to drive may include the steps of: generating a control signal based on the jam detected by the jam detecting means; and automatic admission step of automatically driving the cooling means based on the control signal.

In this method, the automatic admission step may include the steps of: detecting that a door provided at a front body of the image forming apparatus has been opened, thus outputting a drive admitting signal; and driving the drive mechanism of the cooling means based on the output drive admitting signal.

In this case, it is preferable that the cooling means includes a cooling fan as the cooling mechanism for sending a specific airflow in a direction of the medium holding means and a drive motor as the drive mechanism for rotating the cooling fan, the automatic admission step including the steps of: detecting that the door at the front body has been opened, and outputting the drive admitting signal to the drive motor; and driving the drive motor by means of the output drive admitting signal.

Furthermore, in this case, it is preferable that the cooling means includes a refrigerant cooling unit as the cooling mechanism that is provided at a transfer plate that is included in the medium holding means, for cooling the transfer plate by using a refrigerant and a refrigerant circulating unit for circulating the refrigerant of the refrigerant cooling unit, the automatic admission step including the steps of: detecting that the door at the front body has been opened, and outputting the drive admitting signal to the drive mechanism; and driving the drive mechanism by means of the output drive admitting signal.

Moreover, in this method, the automatic admission step may include the steps of: detecting that a door provided at a front body of the image forming apparatus has been opened, thus outputting a drive admitting signal; driving the drive mechanism of the cooling means based on the output drive admitting signal; and a manually operating step of manually operating a drive shut-down switch to stop the cooling mechanism.

Accordingly, the method of controlling a cooling mechanism of a fixing device according to the second basic configuration of the present invention can basically effectively drive the cooling mechanism of the fixing device according to the first basic configuration. The method thus achieves effective cooling to the medium holding means at the outlet side of the fixing unit and the image forming medium transferred and discharged onto the medium holding means, without cooling the fixing device itself, and also without making a user uncomfortable and attachment of toner to the main mechanism of the image forming apparatus.

DETAILED DESCRIPTION OF PREFERRED EMBODIMENTS

Figure 1:
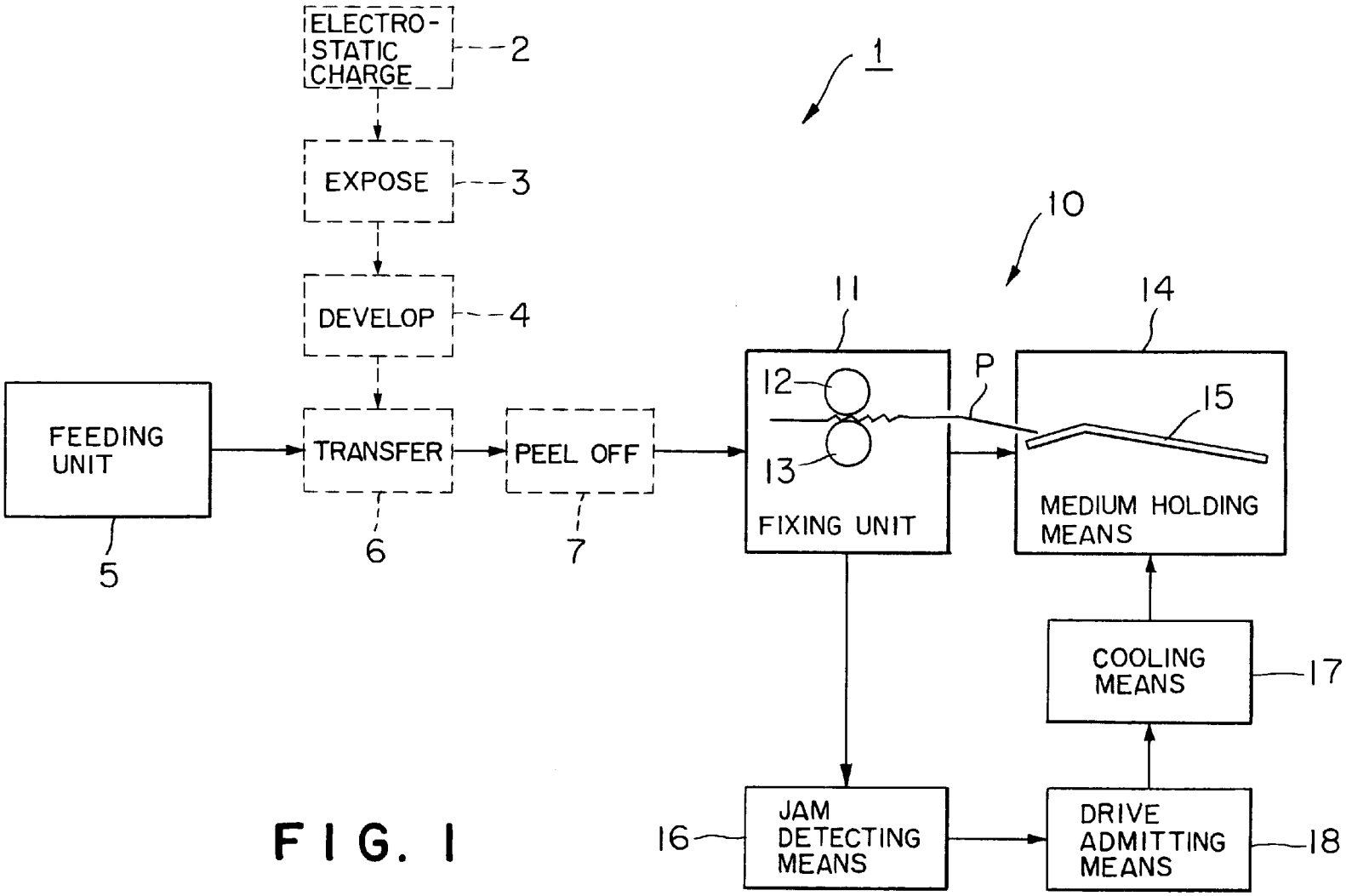
FIG. 1 is a block diagram showing a basic structure of a fixing device having a cooling mechanism as the first embodiment according to the present invention.

Preferred embodiments according to the present invention will be disclosed with reference to the attached drawings. Disclosed first is a fixing device having a cooling mechanism (a basic structure) as the first embodiment according to the present invention with reference to FIGS. 1 to 4. FIG. 1 shows a block diagram of a fixing unit having a cooling mechanism as the first embodiment.

In FIG. 1, an image forming apparatus 1 is provided with an electrostatic charging unit 2 to electrostatically charge a photo conductor drum; an exposure unit 3 to expose the charge drum to a document pattern; a developing unit 4 to deposit a developer, such as, a toner on the pattern on the drum to form a toner image; a feeding unit 5 to feed sheets of paper as an image forming medium; a transfer unit 6 to transfer the toner image developed by the developing unit 4 to a sheet fed by the feeding unit 5; a peeing-off unit 7 to peel off an excess toner from the transferred image; and a fixing device 10 to fix the toner on the transferred image by means of heat and pressure.

The fixing device 10 is used for an image forming apparatus for forming a toner image on a fixing body by an electrophotography process and fixing the image on an image forming medium to which the toner image has been transferred by means of heat and pressure.

The fixing device 10 is provided with a fixing unit 11 having a pair of fixing rollers 12 and 13 for fixing the image on the image forming medium with heat and pressure; a medium holding means 14, situated at the outlet side of the fixing unit 11, to transfer and discharge a sheet "P" as the image forming medium on which the image has been fixed; a jam detecting means 16 to detect jamming in which the fixing roller 12 and 13 have been stopped due to the sheet "P" as the image forming means got caught in the gap between the rollers; a cooling means 17 having a cooling mechanism for cooling the medium holding means 14 and the jamming sheet "P" as the image forming means and a drive mechanism for driving the cooling mechanism; and a drive admitting means 18 to admit the driving mechanism to drive the cooling mechanism to cool the medium holding means 14 and the jamming image forming medium adjacent to the medium holding means.

The medium holding means 14 has a transfer/discharge guide 15 for transferring and discharging the sheet "P" discharged from the fixing unit 11.

Figure 2:
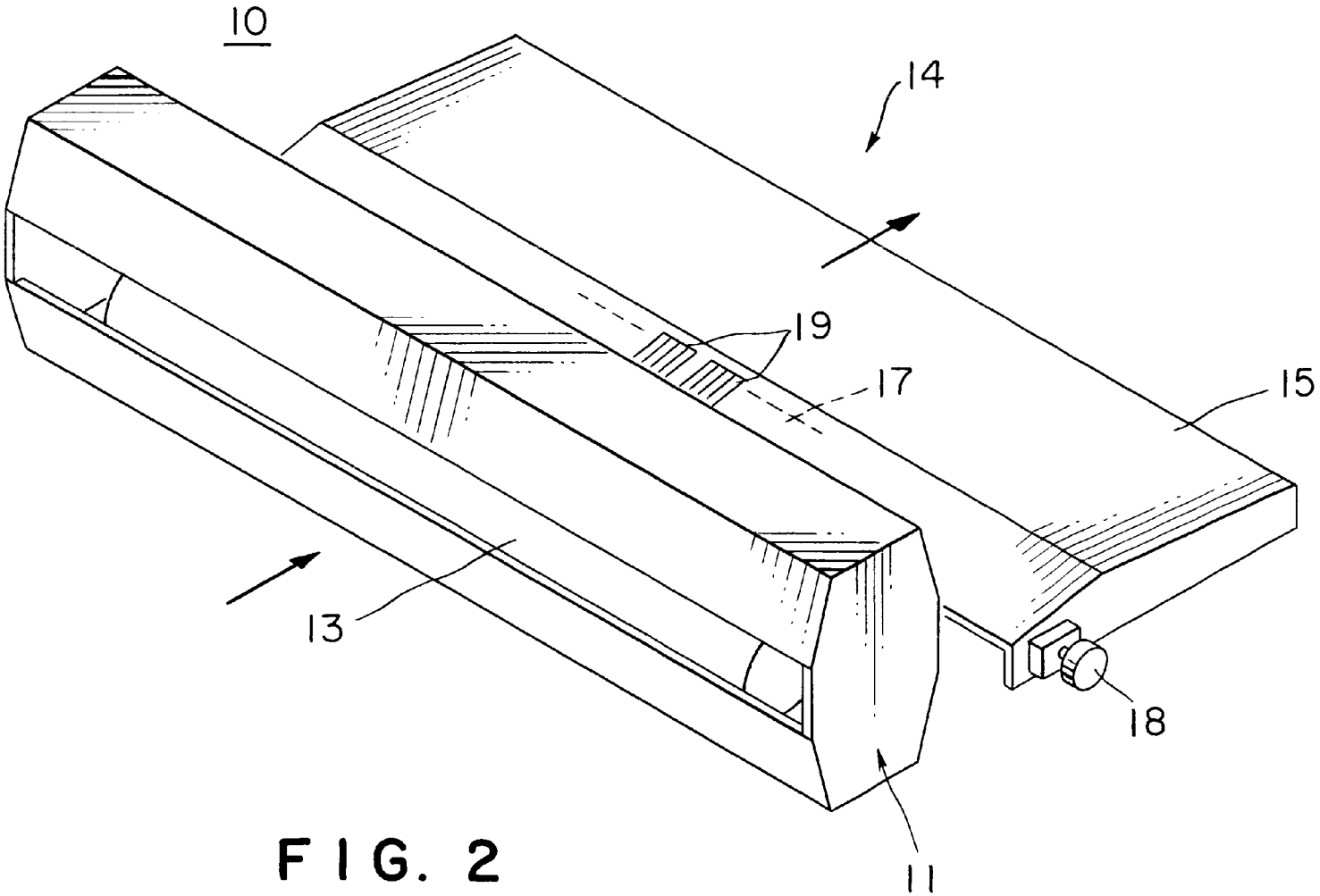
FIG. 2 is a perspective view of a discharge guide unit having a fixing unit and a cooling mechanism of the fixing device according to the first embodiment.
Figure 3:
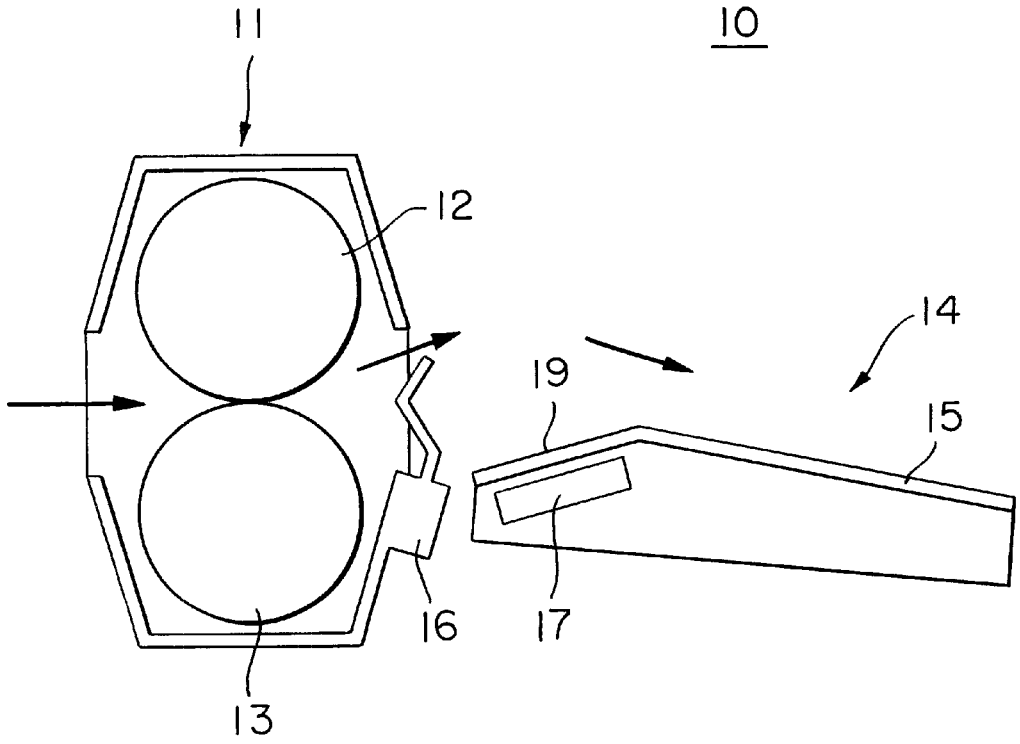
FIG. 3 is a sectional view of the discharge guide unit having the fixing unit and the cooling mechanism of the fixing device according to the first embodiment.

Based on the basic structure shown in FIG. 1, a structure of the cooling means 17 is disclosed with reference to FIGS. 2 and 3.

As illustrated in FIGS. 2 and 3, the fixing device 10 is constituted by the fixing unit 11 and a discharge/transfer guide 14 as the medium holding means. The fixing means unit 11 contains the fixing rollers 12 and 13. A jam detecting sensor 16 as the jam detecting means is situated at the outlet side of the casing of the fixing unit 11.

FIGS. 2 and 3 illustrate the fixing unit 11 to which a sheet as the image forming medium is transferred from left to right in the drawings. Such a sheet is often drawn as transferred from right to left for a usual image forming apparatus. The fixing unit is, however, drawn in FIGS. 2 and 3 in this specification such that a sheet is transferred in the same direction as that shown in FIG. 1 to match the state with each other. The direction illustrated in these drawings is decided in this specification for convenience. The arrows shown in FIGS. 2 and 3 represent the transferring and discharging direction for the sheet as image forming medium.

Attached under the discharge/transfer guide 14 at the fixing unit 11 side is a cooling fan 17 as the cooling means. On the guide 14 at the part along which the sheet discharged from the fixing unit 11 is guided and where the cooling fan 17 is attached, slits are formed in the direction of the arrows in FIGS. 2 and 3 in which the sheet is transferred as the image forming medium.

The slits constitute an opening 19 for cooling. The slits are formed in the direction of sheet transfer so that they will not obstruct the sheet transfer. Moreover, each slit width is narrow enough so that an operator cannot insert his or her finger into any slit while the cooling fan 17 is rotating, to secure safety.

The cooling fan 17 has a switch 18 provided in the vicinity of the fixing device 10 inside the image forming apparatus 1, not on a control panel (not shown). If it were provided on the control panel, a regular operation could be obstructed because the control panel would be locked when a hinged door (not shown) of the apparatus 1 was opened for a jam process. The switch 18 provided in the vicinity of the fixing device 10 is noticeable for a user for ease of use.

The cooling fan 17 is driven to cool a jamming paper and also the heat rollers 12 and 13 a little, which makes long a copier recovery time after jamming.

In order to overcome such a problem, a manual operation only is offered to the switch 18. In detail, the switch 18 is not automatically turned on when a jamming occurs in the fixing device 10 whereas it is turned on when a user depresses it while a jamming paper is heated too much for a user to take out. Moreover, the cooling fan 17 is not driven for a set time, but it is driven while the user is depressing the switch 18.

Figure 4:
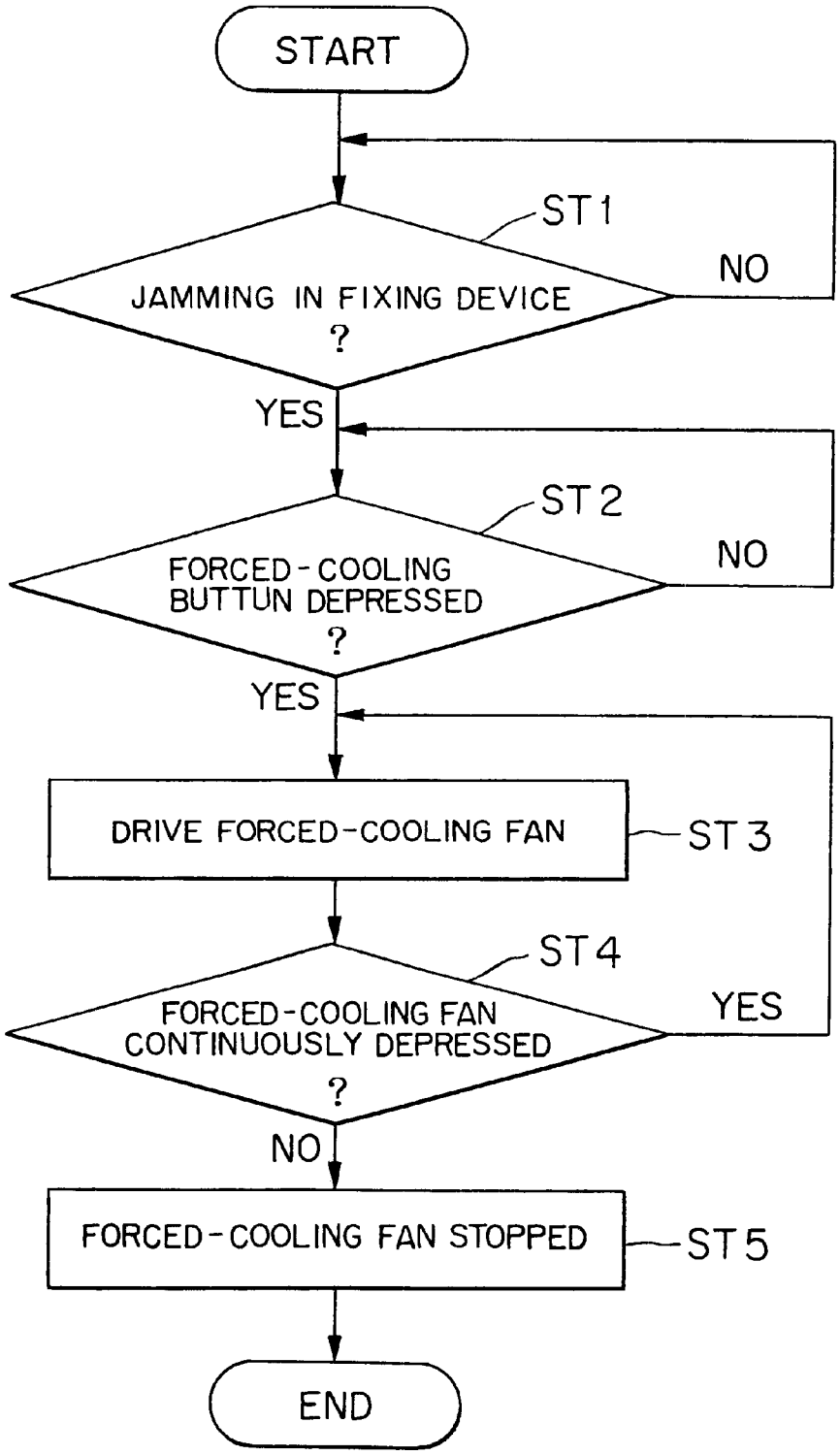
FIG. 4 is a flow chart for explaining a cooling control operation of the fixing device according to the first embodiment.

FIG. 4 shows a flow chart for explaining an operation of the cooling mechanism of the fixing device in the first embodiment.

It is judged whether or not jamming occurs in the fixing device 10 in step ST1. Judged next is whether or not a user depresses the switch 18 for the cooling fan 17 in step ST2. If the force-cooling button 18 is judged as being depressed, the forced-cooling fan 17 is driven in step ST3. It is judged whether the forced-cooling button 18 has been still depressed in step ST4. If it is still depressed, the process goes back to step ST3 in which the forced-cooling fan 17 is continuously driven to cool the top of the sheet that comes out after getting caught in the gap between the fixing roller 12 and 13 is shown.

When a user ceases depressing the force-cooling button 18, it is judged in step ST4 that the button 18 is not depressed anymore and then the forced-cooling fan 17 is stopped in step ST5.

The manual operation described above avoids an unnecessary cooling operation to the heat rollers at the most.

Jamming in the fixing device 10 could occur in front of and after the fixing unit 11, however, will not generate heat so much at the front side. Moreover, the sheet caught in the gap between the fixing rollers 12 and 13 is taken out in the transfer direction. These are the reasons for providing the cooling fan 17 only at the downstream side of the fixing unit 11.

The cooling fan 17 is controlled by the jam detecting sensor 16 and the switch 18. In other words, it is driven only when the jam detecting sensor 16 detects jamming in the fixing device 10 and also the switch 18 is depressed.

Jamming occurring at places other than the fixing device 10 does not allow the cooling fan 17 to be driven even though a user unintentionally touches and depresses the switch 18 while opening the hinged door, thus avoiding unnecessary cooling of the heat rollers 12 and 13.

The cooling mechanism in the first embodiment shown in FIGS. 1 to 4 performs cooling by a user manual operation except judgement on occurrence of jamming by the sensor 16.

Not only this, the present invention offers a complete automatic cooling operation.

Figure 5:
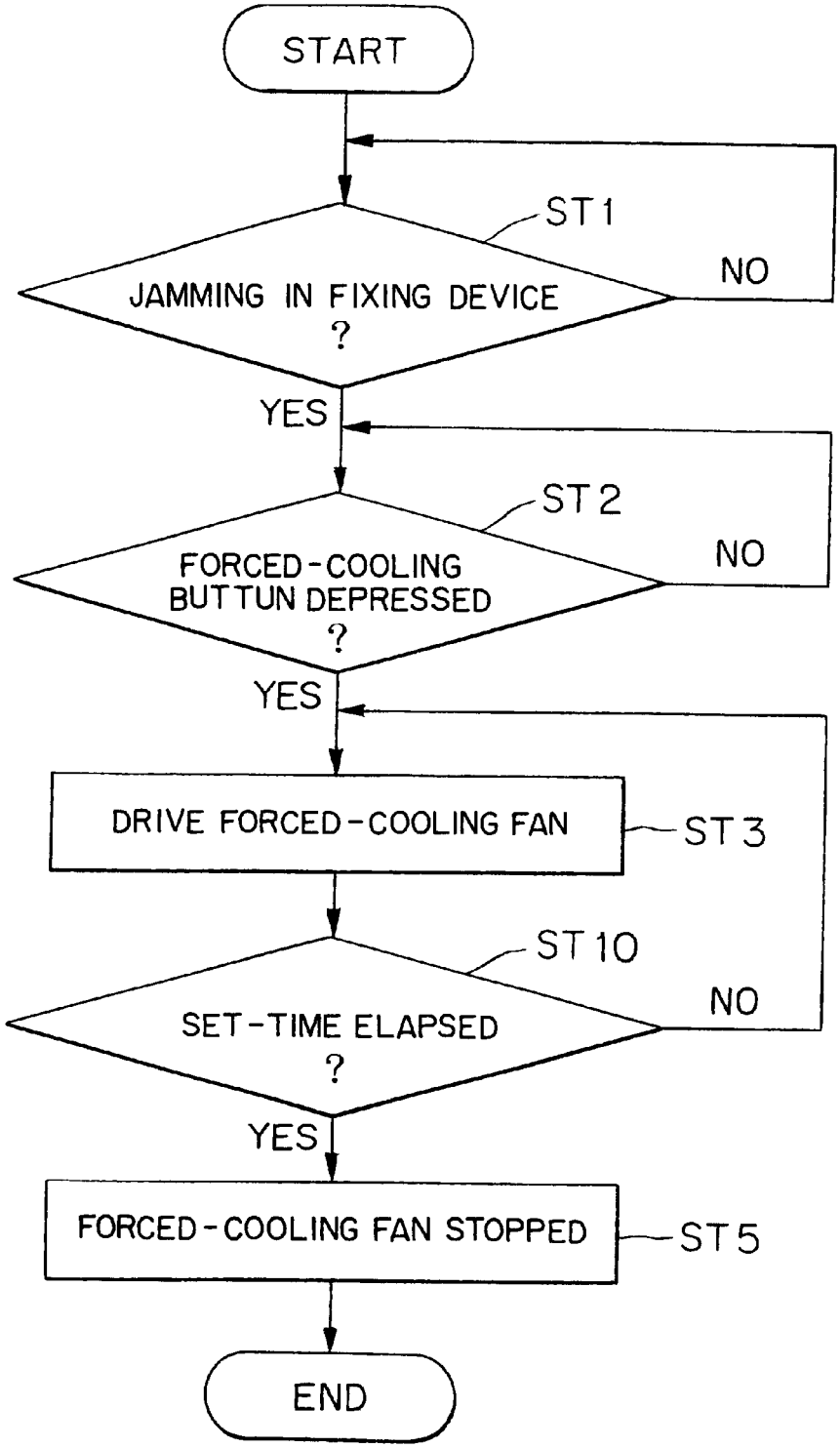
FIG. 5 is a flow chart for explaining a cooling control operation of the fixing device according to the second embodiment.

FIG. 5 shows a flow chart for explaining an operation of the cooling mechanism in the second embodiment.

The basic hardware for the second embodiment is the same as that for the first embodiment shown in FIGS. 1 to 3.

In the second embodiment, an automatic cooling operation is performed for a set time when the forced-cooling button 18 is depressed.

It is judged whether or not jamming occurs in the fixing device 10 in step ST1 by means of a detection signal from the jam detecting sensor 16. If jamming is occurring, judged next is whether or not a user depresses the forced-cooling button 18 in step ST2. If it is depressed, the cooling fan 17 starts in step ST3. It is judged whether a set time has elapsed in step ST10. If not elapsed, the process goes back to step ST3 to continuously drive the cooling fan 17, whereas if elapsed, the process goes to step ST5 to stop the cooling fan 17.

The second embodiment shown in FIG. 5 offers an automatic cooling operation in which, once the switch button 18 is depressed, the forced-cooling fan 17 is driven for a set time by a timer to a jamming paper with no necessity of continuous switch depressing, thus avoiding a complex operation.

Care must be taken for taking out the jamming sheet P got caught between the fixing rollers, however, the second embodiment requires no continuous depressing of the forced-cooling button 18, different from the first embodiment, thus the second embodiment achieves a quick jam process and a simple operation.

Figure 6:
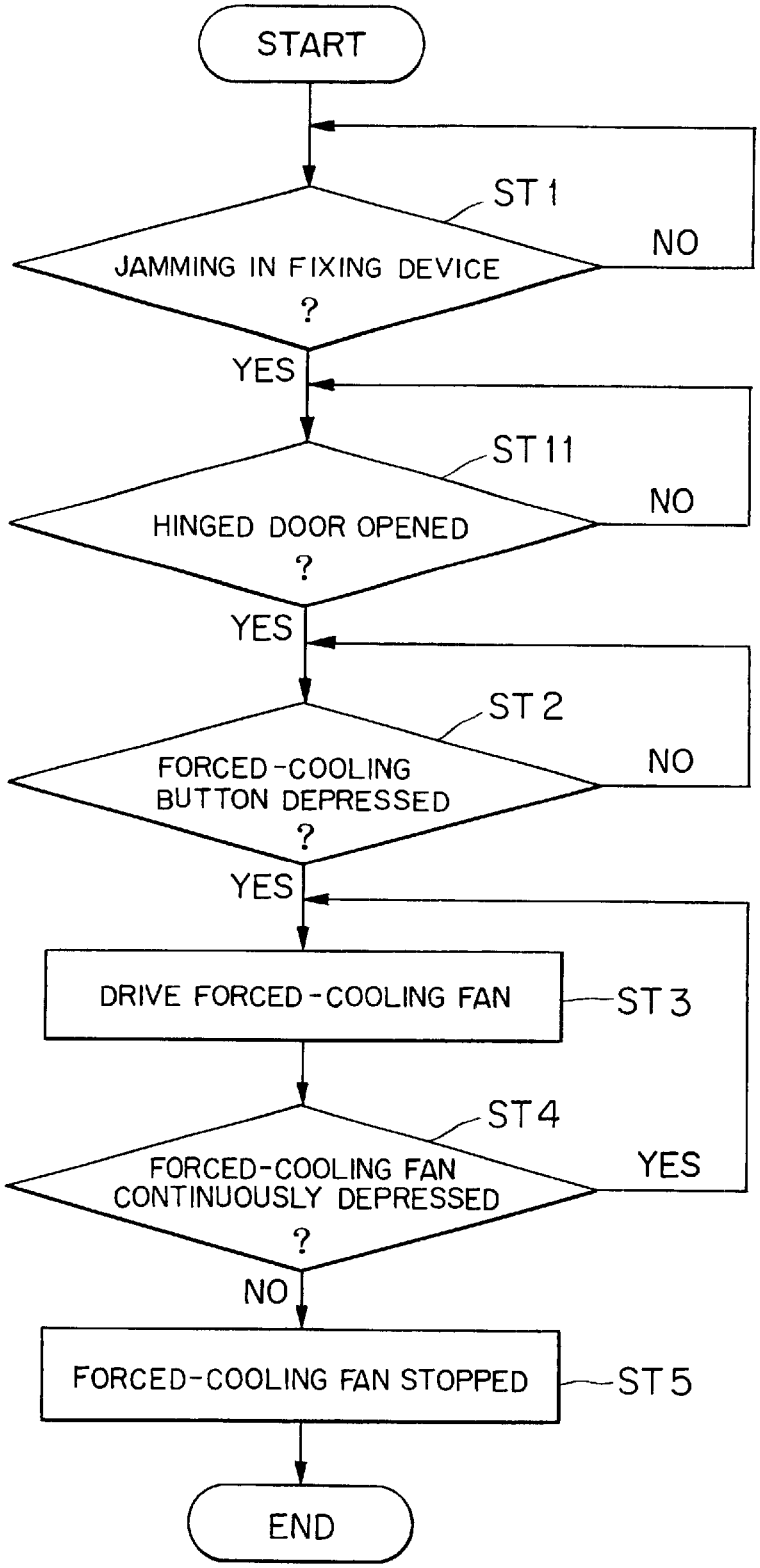
FIG. 6 is a flow chart for explaining a cooling control operation of the fixing device according to the third embodiment.

The third embodiment shown in FIG. 6 includes the step of judgement on whether or not the hinged door is opened, in addition to the steps for the first embodiment. The fourth embodiment shown in FIG. 7 also includes the step of judgement on whether or not the hinged door is opened, in addition to the steps for the second embodiment.

In FIG. 6 for a control operation to the cooling mechanism of the fixing device in the third embodiment, it is judged whether or not jamming occurs in the fixing device in step ST11 by means of a detection signal from the jam detecting sensor 16.

Judged next is whether or not a user has opened the hinged door in step ST11. If the hinged door is judged as being opened, the process follows the same steps shown in FIG. 4 for the first embodiment. A cooling operation continues to a jamming paper while the forced-cooling button 18 has been continuously depressed and when the button 18 is released in step ST4, the forced-cooling fan 17 is stopped in step ST5. Judgement on whether or not the front hinged door of the image forming apparatus 1 is opened is made by means of a detection signal from a sensor to detect contact between the apparatus body and the door.

Figure 7:
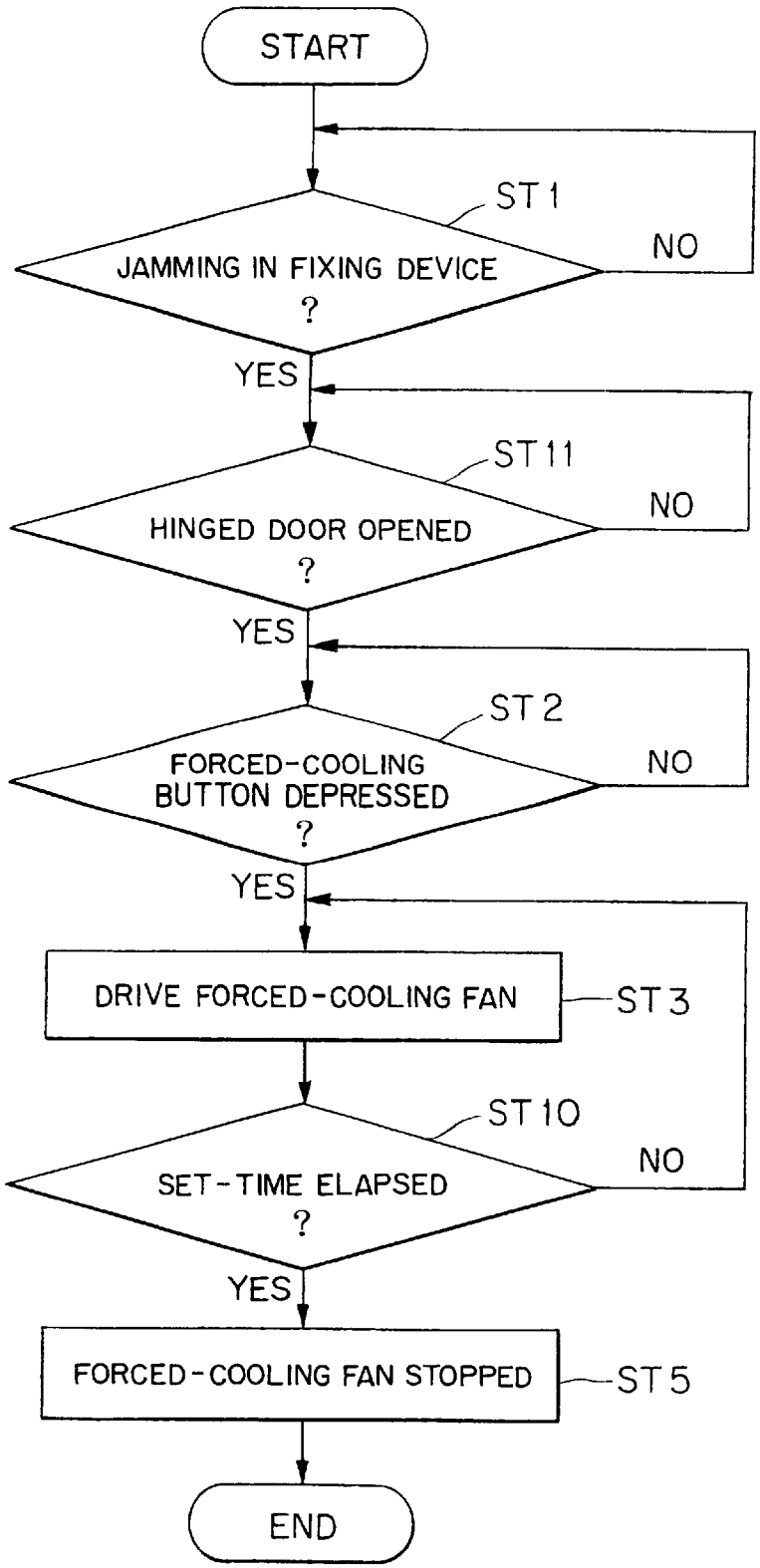
FIG. 7 is a flow chart for explaining a cooling control operation of the fixing device according to the fourth embodiment.

FIG. 7 shows a flow chart for a control operation in the fourth embodiment, like the third embodiment shown in FIG. 6, in which the forced-cooling fan 17 starts when the hinged door of the image forming apparatus 1 is detected to be opened and also the paper jamming is detected.

The difference between the third and the fourth embodiment is that, in the latter, judgement on elapse of a set time is made in step ST10 before stopping the forced-cooling fan 17 in step ST5.

A control operation of the cooling mechanism in the fourth embodiment achieves double security by detection of the hinged door of the image forming apparatus 1 being opened and the paper jamming in the fixing device 10.

The control operations of the cooling mechanism of the fixing device in the first to the fourth embodiments drives the cooling fan 17 to start by depressing the forced-cooling button 18.

However, not limited to this, the invention includes a modification to start a cooling operation just after detection of a paper jamming and then stop the forced-cooling fan 17 when a set time elapses.

Figure 8:
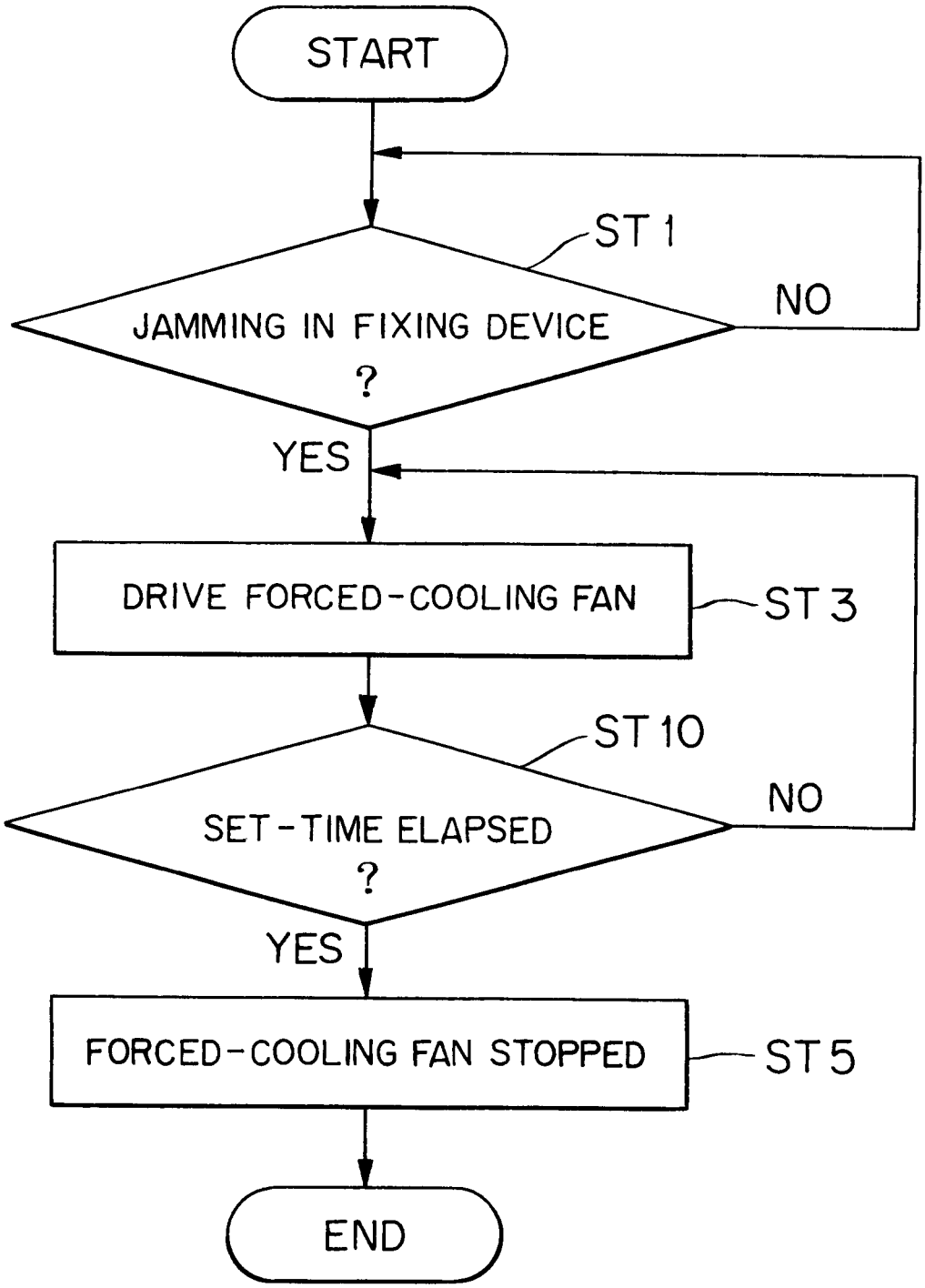
FIG. 8 is a flow chart for explaining a cooling control operation of the fixing device according to the fifth embodiment.

FIG. 8 shows a flow chart for explaining such a control operation of the cooling mechanism of the fixing device in the fifth embodiment.

In FIG. 8, it is judged in step ST1 whether or not a paper jamming has been occurring in the fixing device 10 based on a detection signal from the detector 16 as a jam detecting means. When there is a detection signal from the sensor 16 and it is judged that a paper jamming has been occurring in the fixing device 10, the forced-cooling fan 17 is driven to start in step ST3. After that, it is judged in step ST10 whether or not a set time has elapsed by a timer (not shown), for example. If before elapsing the set time, the process goes back to step ST3 to continue driving of the cooling fan 17. On the other hand, if it is judged in step ST10 that the set time has elapsed, the forced-cooling fan 17 is stopped in step ST5.

The present invention may perform a completely automatic cooling control operation like the fifth embodiment with no manual switch operation when an object to be cooled by the cooling means 17 is not the heat rollers 12 but the top of a sheet caught in the gap between the rollers 12 and 13 at the outlet side of the fixing unit 11.

The foregoing embodiments are disclosed with reference to FIGS. 1 to 3 where the forced-cooling fan 17 cools the sheet P as the image forming that has caused jamming, so as to avoid the cooling the fixing rollers.

However, not limited to this, for example, the present invention may employ the cooling means 17 constituted by a refrigerant cooling unit as a cooling mechanism provided under the transfer guide plate 15 configuring the medium holding means 14, that cools the transfer guide plate 15 by means of a refrigerant and a refrigerant circulating unit as a driving mechanism to circulate the refrigerant in the refrigerant cooling unit.

In this configuration, the jam detecting means may include the jam detecting sensor 16 provided at the outlet side of the fixing rollers 12 and 13, like the first embodiment, and the manual drive admitting unit 18 may include a driving switch for driving the refrigerant to circulate in the refrigerant cooling unit.

Moreover, an automatic control may be performed with an open-door detection switch as an automatic drive admitting unit, to detect an opened hinged-door of the image forming apparatus 1.

As disclosed above, the cooling mechanism of the fixing device of the image forming apparatus according to the present invention includes a cooling fan or a refrigerant cooling mechanism as the cooling means attached to the transfer guide as the discharging unit provided at the outlet side of the fixing device to discharge an image forming medium. The cooling fan or the refrigerant cooling mechanism is driven while a user is depressing the forced-cooling button.

The present invention, when employing the cooling fan, is provided with slits as a cooling window in the direction of transferring copied sheets, at a portion of the transfer guide of the fixing devise, at the rear side of which the cooling fan is attached. The cooling window, the slits provided in the direction of transferring copied sheets, will not cause any problem on transfer. Moreover, each slit width of the cooling window is narrow enough so that a user cannot insert his or her finger into any slit while the cooling fan is rotating, thus causing no injury.

The switch for the cooling fan is provided, not on the control panel, but in vicinity of the fixing device in the image forming apparatus. This is because, the control panel would be locked when the door is opened for jam processing, if such a switch is provided on the control panel; and also the switch provided at a place, such as in vicinity of the fixing device, is noticeable for a user, thus being user friendly.

Cooled by the cooling fan is not only jamming sheets but also the heat rollers which causes lengthening of a recovery time for a copier after jamming process.

To overcome such a drawback, the present invention is configured such that the cooling fan is not automatically driven whenever jamming occurs in the fixing device but it is driven only when a user depresses a switch who cannot take out a heated sheet or do not like to take out such a heated sheet.

Moreover, cooling is not performed for a set time, in other words, the cooling fan is driven while a user is depressing a switch. This arrangement achieves driving of the cooling fan only for a period required by a user, thus minimizing unnecessary cooling of heat rollers.

The cooling fan is provided only the outlet side of the fixing device for the following reasons:

Firstly, jamming would occur at any places before and after the fixing device, however, its occurrence before a sheet is taken into the fixing device mostly generates heat not so much for a user to take it out. Secondary, a jamming sheet in the fixing device is taken out after it is fed in the transferring direction.

The cooling fan is controlled according to an output of the jam detection sensor, furthermore, it is driven by depressing a switch only for jamming in the fixing device. In other words, the cooling fan does not start for jamming outside the fixing device even though the switch is depressed. This mechanism prevents unnecessary cooling of heat rollers.

The same advantages are given by the cooling fan that is configured by the refrigerant cooling mechanism as disclosed in the fifth embodiment.

The refrigerant-cooling mechanism does not spatter heat soon caused by jamming because it is not an air-cooling system like the cooling fan. In other words, the refrigerant-cooling mechanism sends a cooled air directly to a jamming sheet via the guide plate 15 so that no cooled air is not sent toward the heat rollers 12 and 13, thus the rollers being prevented from cooling.

What is claimed is:

1. A fixing device of an image forming apparatus, heated and fixed by which is an image forming medium transferred on which is a toner image formed on an image fixing body by an electrophotography process, the fixing device comprising:

a fixing unit that presses and heats the image forming medium to be fixed by a pair of fixing rollers;

medium holding means provided at an outlet side of the fixing unit for holding the image forming medium, on which image has been fixed, transferred and discharged from the fixing unit;

jam detecting means for detecting a jam in which the image forming medium has been caught between the fixing rollers and not moving;

cooling means including a cooling mechanism for cooling the medium holding means and jamming image forming medium and a drive mechanism for driving the cooling mechanism; and drive admitting means for admitting the drive mechanism to drive the cooling mechanism to cool the medium holding means and the jamming image holding medium located in the vicinity of the medium holding means when the jamming image forming medium is detected by the jam detecting means, wherein the drive admitting means includes a manual drive admitting unit for manually admitting the cooling means to be driven.

2. The fixing device according to claim 1, wherein the manual drive admitting unit includes a drive switch for starting the drive mechanism to drive the cooling mechanism.

3. The fixing device according to claim 2, wherein the cooling means includes a cooling fan as the cooling mechanism for sending a specific airflow in a direction of the medium holding means and a drive motor as the drive mechanism for rotating the cooling fan, the manual drive admitting unit having the drive switch for driving the drive motor for the cooling fan.

4. The fixing device according to claim 2, wherein the cooling means includes a refrigerant cooling unit as the cooling mechanism that is provided at a transfer plate that is included in the medium holding means, for cooling the transfer plate by using a refrigerant and a refrigerant circulating unit as the drive mechanism for circulating the refrigerant of the refrigerant cooling unit, the manual driving admitting unit having the drive switch for driving circulation of the refrigerant of the refrigerant circulating unit provided at an outlet side of the fixing rollers.

5. A fixing device of an image forming apparatus, heated and fixed by which is an image forming medium transferred on which is a toner image formed on an image fixing body by an electrophotography process, the fixing device comprising:

a fixing unit that presses and heats the image forming medium to be fixed by a pair of fixing rollers;

medium holding means provided at an outlet side of the fixing unit for holding the image forming medium, on which an image has been fixed, transferred and discharged from the fixing unit;

jam detecting means for detecting a jam in which the image forming medium has been caught between the fixing rollers and not moving;

cooling means including a cooling mechanism for cooling the medium holding means and jamming image forming medium and a drive mechanism for driving the cooling mechanism; and drive admitting means for admitting the drive mechanism to drive the cooling mechanism to cool the medium holding means and the jamming image holding medium located in the vicinity of the medium holding means when the jamming image forming medium is detected by the jam detecting means, wherein the drive admitting means includes an automatic drive admitting unit for automatically admitting the cooling means to be driven according to a predetermined control signal after the jam has been detected in the jam detecting means, and wherein the automatic drive admitting unit includes a door-open detecting switch for detecting that a door provided at a front body of the image forming apparatus has been opened, thus outputting a drive admitting signal.

6. The fixing device according to claim 5, wherein the cooling means includes a cooling fan as the cooling mechanism for sending a specific airflow in a direction of the medium holding means and a drive motor as the drive mechanism for rotating the cooling fan, the automatic drive admitting unit having the door-open detecting switch for detecting that the door has been opened and outputting the drive admitting signal to the drive motor.

7. The fixing device according to claim 5, wherein the cooling means includes a refrigerant cooling unit as the cooling mechanism that is provided at a transfer plate that is included in the medium holding means, for cooling the transfer plate by using a refrigerant and a refrigerant circulating unit as the drive mechanism for circulating the refrigerant of the refrigerant cooling unit, the automatic driving admitting unit including the door-open detecting switch for detecting that the door has been opened, thus outputting the drive admitting signal to the drive mechanism.

8. A fixing device of an image forming apparatus, heated and fixed by which is an image forming medium transferred on which is a toner image formed on an image fixing body by an electrophotography process, the fixing device comprising:

a fixing unit that presses and heats the image forming medium to be fixed by a pair of fixing rollers;

medium holding means provided at an outlet side of the fixing unit for holding the image forming medium, on which an image has been fixed, transferred and discharged from the fixing unit;

jam detecting means for detecting a jam in which the image forming medium has been caught between the fixing rollers and not moving:

cooling means including a cooling mechanism for cooling the medium holding means and jamming image forming medium and a drive mechanism for driving the cooling mechanism; and drive admitting means for admitting the drive mechanism to drive the cooling mechanism to cool the medium holding means and the jamming image holding medium located in the vicinity of the medium holding means when the jamming image forming medium is detected by the jam detecting means, wherein the drive admitting means includes an automatic drive admitting unit for automatically admitting the cooling means to be driven according to a predetermined control signal after the jam has been detected by the jam detecting means, and said fixing device further comprising a manual drive admitting for manually admitting the cooling means to be driven by controlling the automatic drive admitting unit, the manual drive admitting unit including a drive switch for starting the drive mechanism to drive the cooling mechanism, the automatic drive admitting unit including a door-open detecting switch for detecting that a door provided at a front body of the image forming apparatus has been opened, thus outputting a drive admitting signal.

9. A method of controlling a cooling mechanism of a fixing device of an image forming apparatus, heated and fixed by which is an image forming medium transferred on which is a toner image formed on an image fixing body by an electrophotography process, the fixing device including a fixing unit that presses and heats the image forming medium to be fixed by a pair of fixing rollers, medium holding means provided at an outlet side of the fixing unit for holding the image forming medium, on which an image has been fixed, transferred and discharged by the fixing unit, jam detecting means for detecting a jam in which the image forming medium has been caught between the fixing rollers and not moving, and cooling means including a cooling mechanism for cooling the medium holding means and jamming image forming medium and a drive mechanism for driving the cooling mechanism, the method comprising the steps of:

detecting a jam in which the image forming medium has been caught between the fixing rollers and not moving by the jam detecting means; and admitting the drive mechanism to drive the cooling mechanism to cool the medium holding means and the jamming image forming medium located in the vicinity of the medium holding means, wherein step of admitting the drive mechanism to drive includes the step of driving the drive mechanism of the cooling means by a user manual operation.

10. The method of controlling the cooling mechanism of the fixing device according to claim 9, wherein the step of driving by the user manual operation is performed by depressing a drive switch for starting the drive mechanism to drive the cooling mechanism.

11. The method of controlling the cooling mechanism of the fixing device according to claim 10, wherein the cooling means includes a cooling fan as the cooling mechanism for sending a specific airflow in a direction of the medium holding means and a drive motor as the drive mechanism for rotating the cooling fan, the step of driving by the user manual operation being performed by depressing the drive switch for starting the drive mechanism to drive the cooling fan provided in the vicinity of the fixing rollers.

12. The method of controlling the cooling mechanism of the fixing device according to claim 10, wherein the cooling means includes a refrigerant cooling unit as the cooling mechanism that is provided at a transfer plate that is included in the medium holding means, for cooling the transfer plate by using a refrigerant and a refrigerant circulating unit for circulating the refrigerant of the refrigerant cooling unit, the step of driving by the user manual operation being performed by depressing the drive switch for driving circulation of the refrigerant cooling unit provided at an outlet side of the fixing rollers.

13. A method of controlling a cooling mechanism of a fixing device of an image forming apparatus, heated and fixed by which is an image forming medium transferred on which is a toner image formed on an image fixing body by an electrophotography process, the fixing device including a fixing unit that presses and heats the image forming medium to be fixed by a pair of fixing rollers, medium holding means provided at an outlet side of the fixing unit for holding the image forming medium, on which an image has been fixed, transferred and discharged by the fixing unit, jam detecting means for detecting a jam in which the image forming medium has been caught between the fixing rollers and not moving, and cooling means including a cooling mechanism for cooling the medium holding means and jamming image forming medium and a drive mechanism for driving the cooling mechanism, the method comprising the steps of:

detecting a jam in which the image forming medium has been caught between the fixing rollers and not moving by the jam detecting means; and admitting the drive mechanism to drive the cooling mechanism to cool the medium holding means and the jamming image forming medium located in the vicinity of the medium holding means, wherein the step admitting the drive mechanism to drive includes the steps of:

generating a control signal based on the jam detected by the jam detecting means: and automatic admission step of automatically driving the cooling means based on the control signal, and wherein the automatic admission step includes the steps of:

detecting that a door provided at a front body of the image forming apparatus has been opened, thus outputting a drive admitting signal; and driving the drive mechanism of the cooling means based on the output drive admitting signal.

14. The method of controlling the cooling mechanism of the fixing device according to claim 13 wherein the cooling means includes a cooling fan as the cooling mechanism for sending a specific airflow in a direction of the medium holding means and a drive motor as the drive mechanism for rotating the cooling fan, the automatic admission step including the steps of:

detecting that the door at the front body has been opened, and outputting the drive admitting signal to the drive motor; and driving the drive motor by means of the output drive admitting signal.

15. The method of controlling the cooling mechanism of the fixing device according to claim 13 wherein the cooling means includes a refrigerant cooling unit as the cooling mechanism that is provided at a transfer plate that is included in the medium holding means, for cooling the transfer plate by using a refrigerant and a refrigerant circulating unit for circulating the refrigerant of the refrigerant cooling unit, the automatic admission step including the steps of:

detecting that the door at the front body has been opened, and outputting the drive admitting signal to the drive mechanism; and driving the drive mechanism by means of the output drive admitting signal.

16. A method of controlling a cooling mechanism of a fixing device of an image forming apparatus, heated and fixed by which is an image forming medium transferred on which is a toner image formed on an image fixing body by an electrophotography process, the fixing device including a fixing unit that presses and heats the image forming medium to be fixed by a pair of fixing rollers, medium holding means provided at an outlet side of the fixing unit for holding the image forming medium, on which an image has been fixed, transferred and discharged by the fixing unit, jam detecting means for detecting a jam in which the image forming medium has been caught between the fixing rollers and not moving, and cooling means including a cooling mechanism for cooling the medium holding means and jamming image forming medium and a drive mechanism for driving the cooling mechanism, the method comprising the steps of:

detecting a jam in which the image forming medium has been caught between the fixing rollers and not moving by the jam detecting means; and admitting the drive mechanism to drive the cooling mechanism to cool the medium holding means and the jamming image forming medium located in the vicinity of the medium holding means, wherein the step admitting the drive mechanism to drive includes the steps of:

generating a control signal based on the jam detected by the jam detecting means; and automatic admission step of automatically driving the cooling means based on the control signal, and wherein the automatic admission step includes the steps of:

detecting that a door provided at a front body of the image forming apparatus has been opened, thus outputting a drive admitting signal;

driving the drive mechanism of the cooling means based on the output drive admitting signal; and a manually operating step of manually operating a drive switch to stop the cooling mechanism.

* * * * *